US008872704B2

(12) United States Patent
Chung et al.

(10) Patent No.: US 8,872,704 B2
(45) Date of Patent: Oct. 28, 2014

(54) INTEGRATED ANTENNA AND METHOD FOR OPERATING INTEGRATED ANTENNA DEVICE

(75) Inventors: Shyh-Jong Chung, Hsinchu (TW); Ya-Ping Chen, Hsinchu (TW)

(73) Assignee: National Chiao Tung University (TW)

( * ) Notice: Subject to any disclaimer, the term of this patent is extended or adjusted under 35 U.S.C. 154(b) by 147 days.

(21) Appl. No.: 13/343,333

(22) Filed: Jan. 4, 2012

(65) Prior Publication Data

US 2013/0082894 A1 Apr. 4, 2013

(30) Foreign Application Priority Data

Oct. 4, 2011 (TW) ..... 100135964 A

(51) Int. Cl.
*H01Q 1/38* (2006.01)
*H01Q 9/04* (2006.01)
*H01Q 9/28* (2006.01)

(52) U.S. Cl.
CPC ..... *H01Q 9/0457* (2013.01); *H01Q 9/285* (2013.01)
USPC ..... 343/700 MS

(58) Field of Classification Search
CPC ..... H01Q 1/38; H01Q 9/0407; H01Q 9/0421
USPC ..... 343/700 MS
See application file for complete search history.

(56) References Cited

U.S. PATENT DOCUMENTS

| | | | | |
|---|---|---|---|---|
| 2001/0000659 | A1 * | 5/2001 | Hayashi et al. | 340/10.34 |
| 2003/0151561 | A1 * | 8/2003 | Arisawa et al. | 343/867 |
| 2009/0021439 | A1 * | 1/2009 | Kanno et al. | 343/767 |
| 2009/0109100 | A1 * | 4/2009 | Sato | 343/702 |
| 2009/0273418 | A1 * | 11/2009 | Shimizu et al. | 333/24 R |
| 2010/0073238 | A1 * | 3/2010 | Jun et al. | 343/700 MS |

* cited by examiner

*Primary Examiner* — Dameon E Levi
*Assistant Examiner* — Collin Dawkins
(74) *Attorney, Agent, or Firm* — Volpe and Koenig, P.C.

(57) ABSTRACT

An integrated antenna is provided. The integrated antenna includes a first resonant element disposed on a chip, and receiving a first signal having a frequency from the chip; and a second resonant element disposed on a substrate, wherein the chip is disposed on the substrate, and the first signal enables a non-contact resonant coupling to be established between the first resonant element and the second resonant element due to the frequency to cause the second resonant element to generate and radiate a second signal.

19 Claims, 7 Drawing Sheets

INTEGRATED ANTENNA AND METHOD FOR OPERATING INTEGRATED ANTENNA DEVICE

FIELD OF INVENTION

The present invention relates to an integrated antenna and a method for manufacturing the same, and more particularly to an integrated antenna and a method for manufacturing the same via non-contact resonant coupling.

BACKGROUND

The application of the wireless communication has already become the mainstream technology of the consumer electronic products. In recent years, with the development of millimeter-wave frequency technology, the applications of high-speed data rate transmission of the wireless personal area network (WPAN) and general vehicular radar system both use the frequency up to tens of Giga Hertz. Because the wireless communication apparatus operating at millimeter-wave frequency can carry large number of data for transmission, it is quite suitable for applications of WPAN and the vehicular radar system. In millimeter-wave circuit technology, the design of system on chip (SoC) provides a small circuit size and facilitates mass production. In fact, the transmitter or receiver currently used in wireless communication apparatus has already been designed as a chip, and the antenna needs to be disposed at the front end of the transmitter or receiver to perform the signal transmission and reception.

In millimeter-wave communication applications, there are two methods to dispose the antenna. The first is to dispose the antenna on chip with the transmitter or receiver, which is called chip antenna. The second is to manufacture the antenna on the printed circuit board (PCB), and then integrate the antenna with the transmitter or receiver on chip by electrical connecting methods. Generally, the electrical connecting methods can be wire bonding, flip-chip, etc.

Please refer to FIG. 1(*a*), which shows an antenna 10 disposed on a chip in the prior art. The antenna 10 is the so-called Yagi chip antenna. As shown in FIG. 1(*a*), a resonant element 12 is disposed on the silicon substrate 11 of the chip. The resonant element 12 is connected to the feed-in point 13 for the antenna signal. Generally, the transmitter or receiver feeds the signal into the resonant element 12 via the feed-in point 13. The antenna signal can be resonated in the resonant element 12. Besides, the resonant element 12 also serves as the radiation element of the antenna 10 for transmitting the antenna signal. Please refer to FIG. 1(*b*), which shows the antenna 10 disposed on a printed circuit board 110. The advantage of the chip antenna is that the circuit of the resonant element 12 is integrated with the chip, which avoids the issues of the energy loss and impedance mismatching resulting from the substantial electrical connecting path such as the wire bonding or flip-chip. However, the material of the substrate 11 of the chip usually causes the energy loss, thereby deteriorating the radiation efficiency and radiation gain of the antenna. Please refer to FIGS. 1(*c*)-1(*d*), which show the radiation gain patterns of the antenna 10 of FIG. 1(*a*). FIG. 1(*c*) shows the radiation pattern of the signal of 60 GHz in the y-z plane, and FIG. 1(*d*) shows the radiation pattern of the signal of 60 GHz in the x-z plane. Generally, the radiation gain usually can reach 7~9 dBi by using the Yagi antenna. However, by using this highly-directional Yagi antenna, the radiation gain and efficiency of the antenna in the chip still are only −10 dBi and about 10% respectively. This fully proves that the high-loss silicon substrate for manufacturing the chip greatly affects the efficiency of the antenna, which is a disadvantage of the chip antenna.

Compared to chip antenna, the method for manufacturing the antenna on the PCB has a lower cost and a lower energy loss of the signal, and the efficiency of the antenna usually can be above 80~90%, which far surpasses the chip antenna with the efficiency of about 10%. However, for transmitting the signal from the chip to the antenna on the PCB, when applied in the millimeter-wave frequency band (e.g. 77 GHz), the conventional wire bonding or flip-chip technologies cause the issues of energy loss. Also the length of wire bonding causes radiation and the parasitic effects coming from capacitor and inductor due to the substantial circuit structure. When designing the antenna, these parasitic effects have to be considered in advance, and the compensation circuit shall be made with a more complex circuit design. Besides, the request for the process management of the wire bonding or flip-chip is relatively complicated, which increases lots of extra costs and the difficulty in manufacturing the antenna.

In order to overcome the drawbacks in the prior art, an integrated antenna and a method for operating an integrated antenna device are provided. The particular design in the present invention not only solves the problems described above, but also is easy to be implemented. Thus, the present invention has the utility for the industry.

SUMMARY

In accordance with an aspect of the present invention, an integrated antenna and a method for operating an integrated antenna device are provided, which not only have the advantages of lower cost and higher antenna efficiency but also prevent the issues resulting from the substantial circuit connection between the chip and PCB. The present invention uses the non-contact resonant coupling method to replace the conventionally substantial circuit connection between the chip and PCB, e.g. the wire bonding or flip-chip.

In accordance with another aspect of the present invention, an integrated antenna is provided. The integrated antenna includes a first resonant element disposed on a chip, and receiving a first signal having a frequency from the chip; and a second resonant element disposed on a substrate, wherein the chip is disposed on the substrate, and the first signal enables a non-contact resonant coupling to be established between the first resonant element and the second resonant element due to the frequency to cause the second resonant element to generate and radiate a second signal.

In accordance with a further aspect of the present invention, an integrated antenna is provided. The integrated antenna is disposed at a first substrate and a second substrate, and includes a first coupling element disposed at the first substrate, and receiving a feed-in signal; and a second coupling element disposed at the second substrate, wherein the feed-in signal enables a non-contact resonant coupling to be established between the first coupling element and the second coupling element.

In accordance with a further aspect of the present invention, a method for operating an integrated antenna device is provided. The method includes steps of disposing a first resonant element at a first substrate; feeding a signal into the first resonant element, wherein the first resonant element is resonated in response to the signal; and disposing a second resonant element at a second substrate, wherein the signal enables a non-contact resonant coupling to be established between the first resonant element and the second resonant element.

The above objects and advantages of the present invention will become more readily apparent to those ordinarily skilled in the art after reviewing the following detailed descriptions and accompanying drawings, in which:

BRIEF DESCRIPTION OF THE DRAWINGS

FIG. 1(*b*) shows the chip antenna disposed on a printed circuit board;

FIGS. 1(*c*)-1(*d*) show the radiation gain patterns of the chip antenna of FIG. 1(*a*);

FIG. 2(*b*) is a top view of the integrated antenna via non-contact coupling of FIG. 2(*a*);

FIG. 3(*b*) shows the radiation gain pattern of the integrated antenna of FIG. 2(*a*);

FIG. 7(*b*) shows the antenna effects of the first and the second resonant elements of the present invention, wherein the relative positions thereof are changed along the y direction.

DETAILED DESCRIPTION OF THE PREFERRED EMBODIMENTS

The present invention will now be described more specifically with reference to the following embodiments. It is to be noted that the following descriptions of preferred embodiments of this invention are presented herein for the purposes of illustration and description only; it is not intended to be exhaustive or to be limited to the precise form disclosed.

According to the basic idea of the present invention, the antenna signal is transmitted from the integrated antenna device which is composed of a resonant element on chip and another resonant element on PCB via non-contact resonant coupling. This not only has the advantages of lower cost and higher antenna efficiency but also prevents the issues resulting from the substantial circuit connection between the chip and PCB.

Figure 1A:
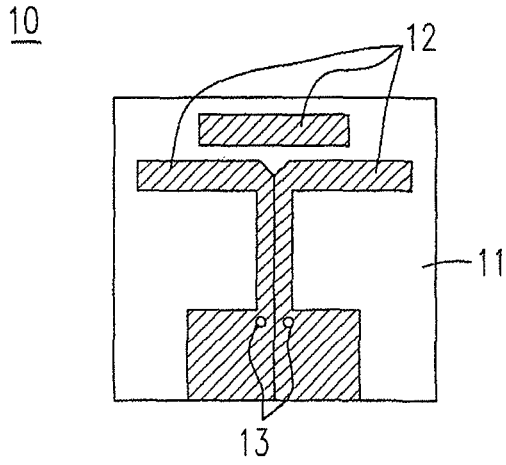
Fig. 1(a)(Prior Art)
FIG. 1(*a*) shows an antenna disposed on a chip in the prior art.
Figure 1B:
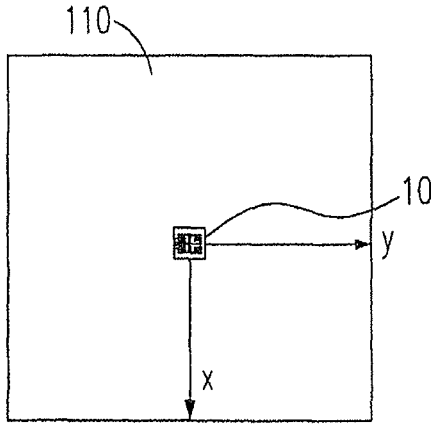
Fig. 1(b)(Prior Art)
Figure 1C:
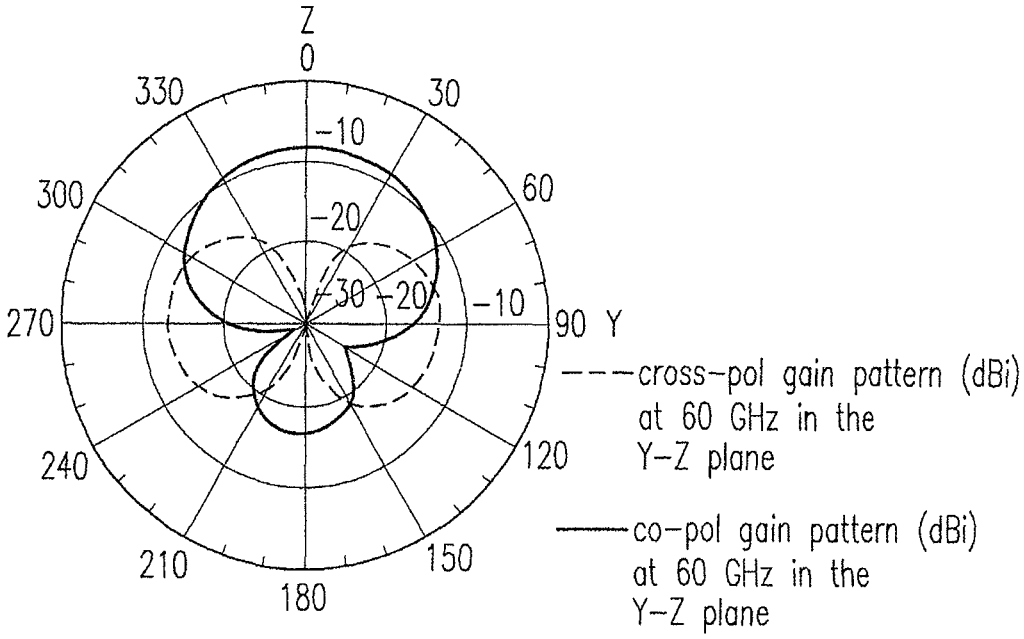
Fig. 1(c)(Prior Art)
Figure 1D:
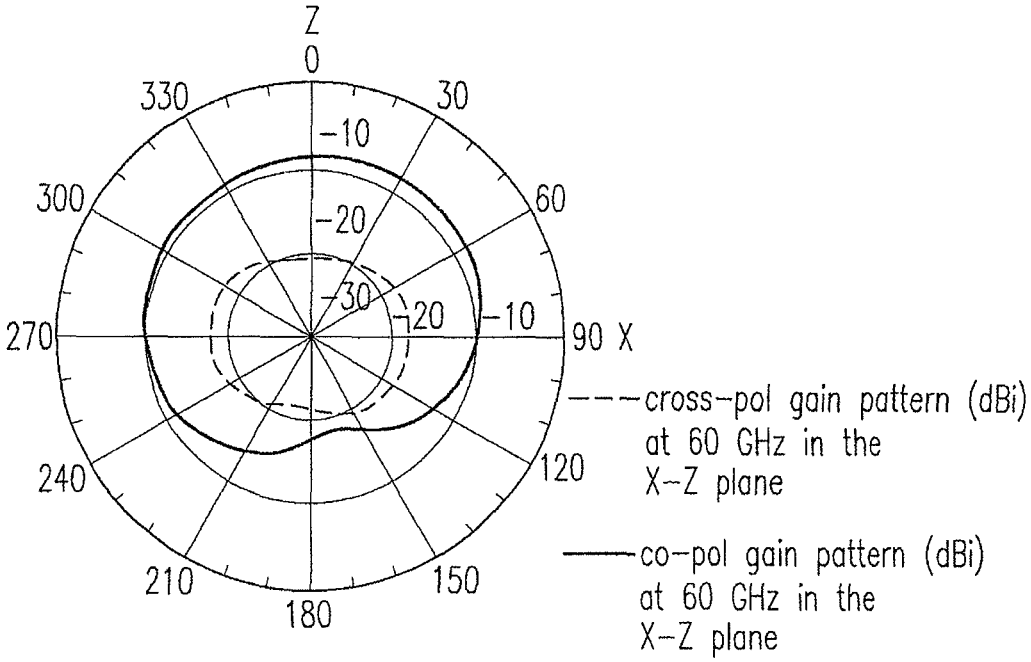
Fig. 1(d)(Prior Art)
Figure 2A:
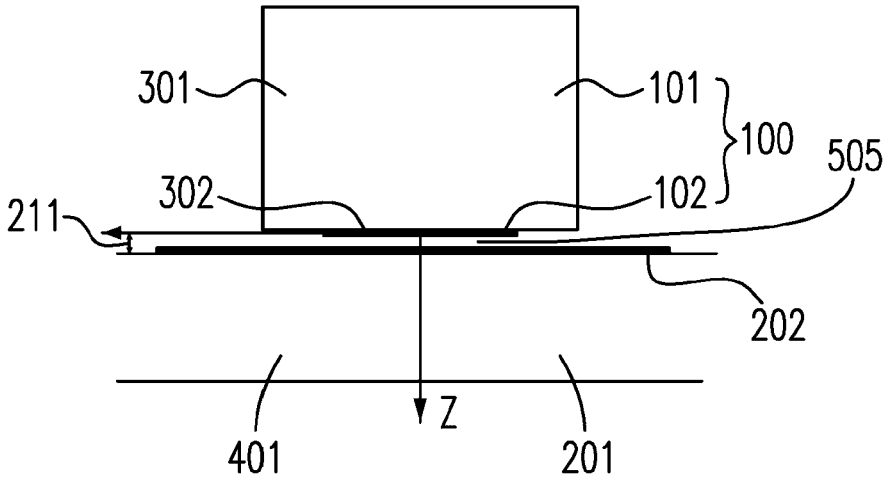
FIG. 2(*a*) is a cross-sectional view of an integrated antenna via non-contact resonant coupling according to an embodiment of the present invention.
Figure 2B:
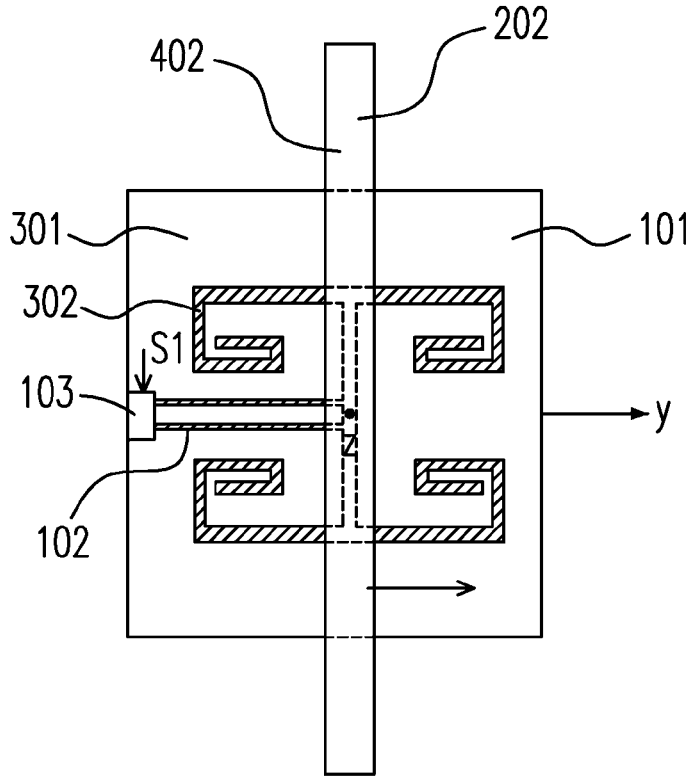

Please refer to FIG. 2(*a*), which is a cross-sectional view of an integrated antenna via a non-contact resonant coupling 505 according to an embodiment of the present invention. As shown in FIG. 2(*a*), a chip 100 is disposed above a PCB substrate 201, and a first resonant element 102 is disposed at the lower side of a silicon substrate 101 of the chip 100. A second resonant element 202 is disposed on the PCB substrate 201 near the position of the chip 100. There is a gap 211 between the first resonant element 102 and the second resonant element 202, e.g. about 60 microns, so that the first resonant element 102 does not contact the second resonant element 202. As shown in FIG. 2(*a*), a preferred structure of the first resonant element 102 is obtained by manufacturing the antenna as a planar shape. For receiving and transmitting the antenna signal with a specific frequency more efficiently, preferably the conducting path (open circuit or short circuit) of the first resonant element 102 has a length being one-fourth, a half or a multiple of the wavelength of the signal of the first resonant element 102. In addition, the first resonant element 102 can be an inductive or capacitive element, which uses the inductive or capacitive resonant coupling to enable the received feed-in signal S1 to be resonated in the first resonant element 102 and coupled to the second resonant element 202, thereby transmitting the antenna signal. Similarly, the function of the second resonant element 202 disposed on the PCB substrate 201 is also for transmitting or receiving the antenna signal with the specific frequency. Hence, preferably the conducting path of the resonant element 202 also has a length being one-fourth, a half or a multiple of the wavelength of the transmitted or received signal, so that the second resonant element 202 is also resonated due to the transmitted or received signal. Theoretically, signals of the first resonant element 102 of the chip 100 can be all coupled to the second resonant element 202 of the PCB substrate 201 by using the principle of resonant element coupling. The second resonant element 202 of FIG. 2(*a*) is also a radiation unit so that it can be a resonant antenna such as a general dipole antenna, microstrip antenna, Yagi antenna, etc.

Please refer to FIG. 2(*b*), which is a top view of the integrated antenna via the non-contact coupling of FIG. 2(*a*). FIG. 2(*b*) shows the respective positions of the first resonant element 102 and the second resonant element 202. The first resonant element 102 can receive a first signal (not shown) from a chip with transmission circuit (not shown) via a feed-in point 103. Specifically, the first signal has a specific frequency. Since the first signal passes through the silicon substrate 101 and has a first wavelength, the first wavelength depends on the dielectric constant of the silicon substrate 101. Because the specific frequency is the resonant frequency of the first resonant element 102 and that of the second resonant element 202 simultaneously, according to the configuration of FIG. 2(*b*), when the first signal is transmitted to the first resonant element 102, the resonant coupling between the first resonant element 102 and the second resonant element 202 will be induced. This enables the second resonant element 202 to generate a second signal (not shown) having the specific frequency. Then, the second signal is transmitted by the second resonant element 202. At this time, the second resonant element 202 of the PCB substrate 201 (not shown in FIG. 2 (*b*)) simultaneously has the function of an antenna radiation element. The conducting path of the first resonant element 102 of FIG. 2(*b*) is curved to a small size, which utilizes the area occupied on the silicon substrate 101 of the chip 100 more efficiently, thereby saving the production cost.

As described above, preferably the conducting path of the second resonant element 202 has a length being one-fourth, a half or a multiple of the wavelength of the second signal transmitted (not shown) so that the second resonant element 202 is resonated due to the second signal transmitted. The conducting path can be an open circuit structure or a short circuit structure; in this embodiment, the conducting path is an open circuit structure. The wavelength of the second signal depends on the dielectric constant of the PCB substrate 201. Therefore, the antenna designer can decide the sizes of the first and second resonant elements 102, 202 based on the respective dielectric constants of the silicon substrate 101 and the PCB substrate 201 as well as the appropriate operation frequency band of the antenna. Basically, the first signal and the second signal described above simultaneously have the specific frequency. Under this condition, the first signal passing through the chip 100 can enable the second resonant element 202 of the PCB substrate 201 to generate the second signal via non-contact resonant coupling 505 between the first and the second resonant elements 102, 202. Contrarily, since the second resonant element 202 itself also has the function of an antenna radiation element, the antenna signal received by the second resonant element 202 from the outside can also be coupled to the circuit on the chip 100 via the first and the second resonant elements 102, 202. Basically, the non-contact resonant coupling of the present invention is the coupling between the first and the second resonant elements 102, 202. In other words, the first and the second resonant elements 102, 202 can be respectively referred to as a first coupling element 302 and a second coupling element 402; and the silicon substrate 101 and the PBC substrate 201 can be respectively referred to as a first substrate 301 and a second substrate 401.

Figure 3A:
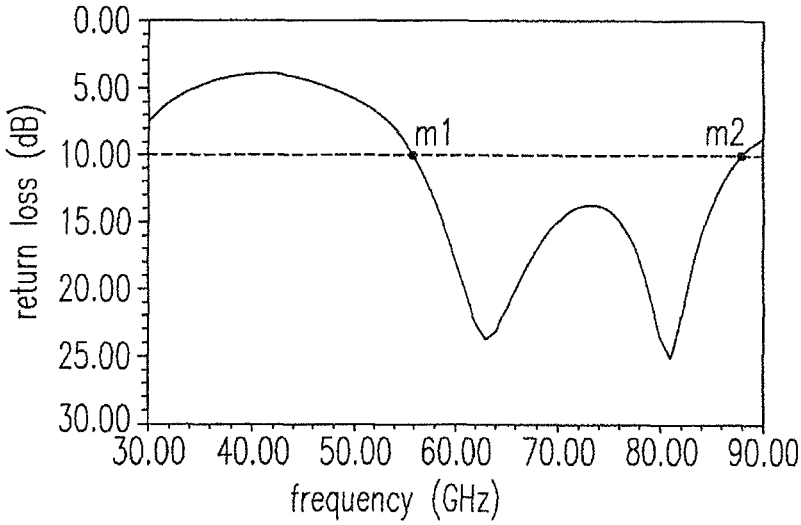
FIG. 3(*a*) shows a simulation result of the embodiment of FIG. 2(*a*)
Figure 3B:
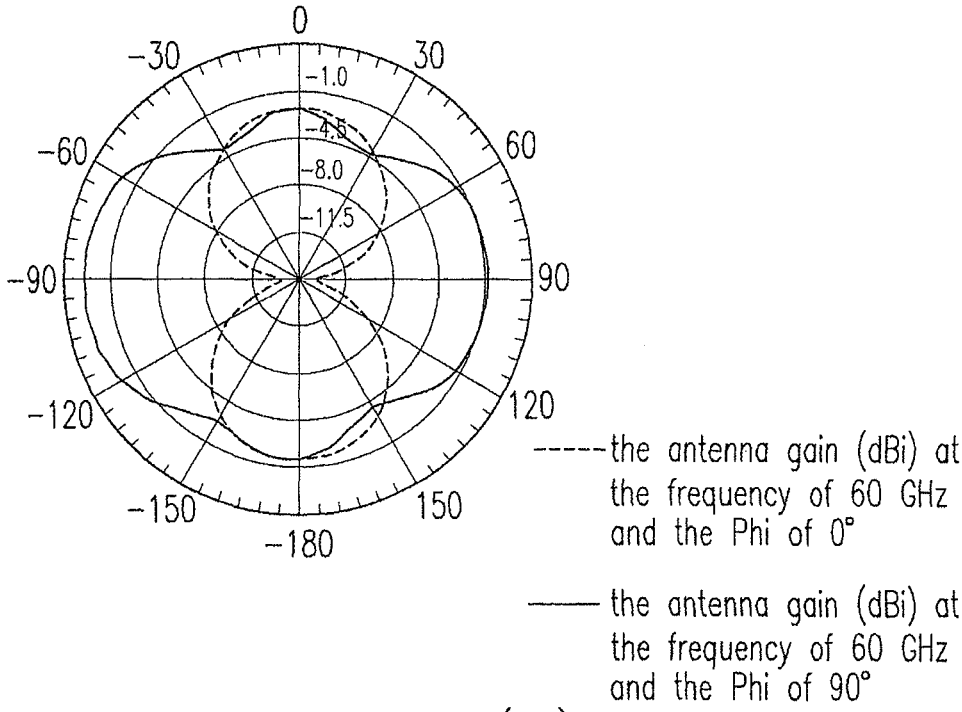

The equivalent circuit of the resonator usually includes an inductor and a capacitor. The present invention uses the structural design to enable the first resonant element 102 to have the strongest current distribution at a specific position. Then, the current is coupled to the second resonant element 202 having the function of an antenna radiation element via inductive coupling. The first and the second resonant elements 102, 202 are not limited to the way of inductive coupling; the way of capacitive coupling or the way of a combination of inductive coupling with capacitive coupling can also be used for the first and the second resonant elements 102, 202. Compared to the conventional way of connecting the chip and PCB by using the substantial circuit, the integrated antenna of the present invention greatly enhances the radiation gain and efficiency of the antenna. FIG. 3(*a*) shows a simulation result of the embodiment of FIG. 2(*a*), wherein the central frequency is 60 GHz, and the portion between m1 and m2 is regarded as the range of the available bandwidth (about 56~88 GHz), which is suitable for use in WPAN radar or vehicular radar. However, the present invention is not limited to the application of this frequency band, but can be widely applied to the application of integrating the chip circuit with the PCB substrate.

FIG. 3(*b*) shows the radiation gain patterns of the integrated antenna of FIG. 2(*a*), wherein the radiation gain patterns of the 60 GHz signal in the x-z and y-z planes are shown, which are consistent with those of the dipole antenna. This represents that the integrated antenna of the present invention can successfully excite the dipole antenna. Besides, the gain of the integrated antenna of the present invention can be maintained at about 1 dB. Moreover, the radiation gain pattern of the integrated antenna of the present invention is an omni- directional radiation gain pattern. And the gain of the integrated antenna of the present invention is far larger than that of the general chip antenna.

Figure 4:
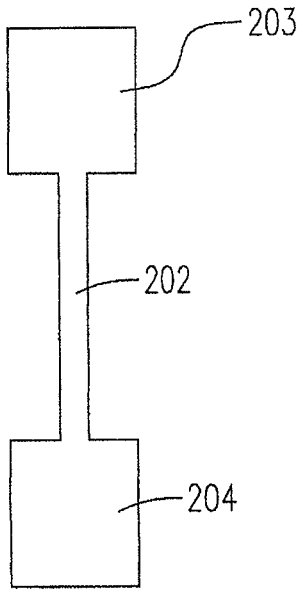
FIG. 4 shows an antenna element disposed on the printed circuit board according to another embodiment of the present invention.
Figure 5:
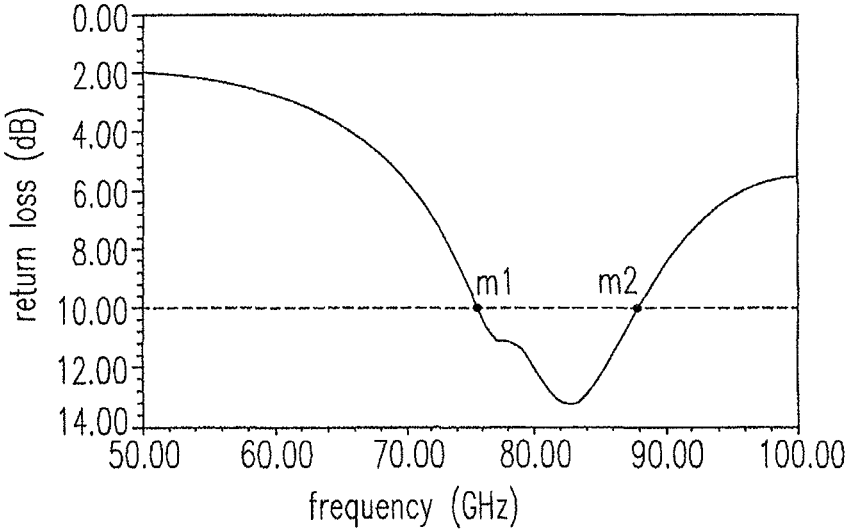
FIG. 5 shows a simulation result of the embodiment of FIG. 4.

The second resonant element 202 of FIG. 2(*b*) is bar-shaped. However, the skilled person can change the structure of the antenna and select different types of antennas according to actual needs. For example, the type of the antenna can be either of the resonant antennas such as the microstrip antenna, the Yagi antenna, etc. Please refer to FIG. 4, which shows an antenna element disposed on the printed circuit board according to another embodiment of the present invention. As shown in FIG. 4, the radiation elements 203, 204 are disposed at two ends of the second resonant element 202. Please refer to FIG. 5, which shows a simulation result of the embodiment of FIG. 4. The range of the available bandwidth of this embodiment is about 75~88 GHz, which is suitable for use in a vehicular antenna. The skilled person can know from this embodiment that the antenna element disposed on the PCB substrate can use the second resonant element 202 to cooperate with the appropriate radiation element for different specific operating frequency bandwidths, so as to obtain the technical scheme of the integrated antenna of the present invention.

Figure 6:
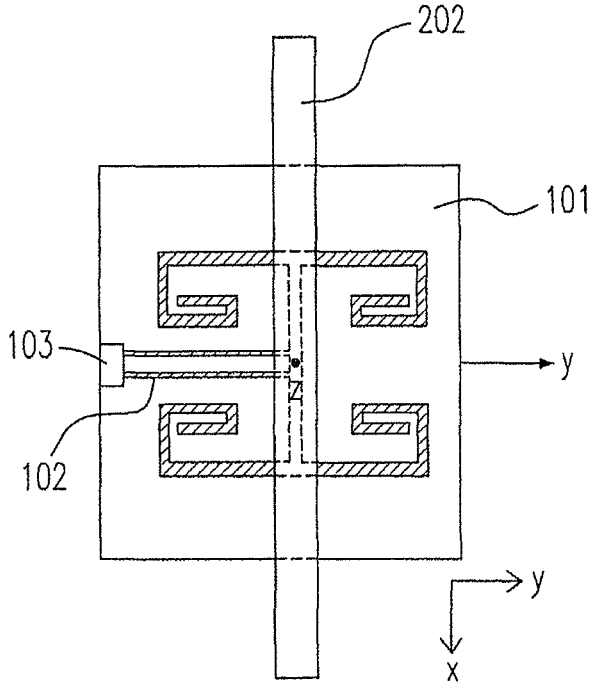
FIG. 6 shows the relative positions of the two resonant elements of the present invention.
Figure 7A:
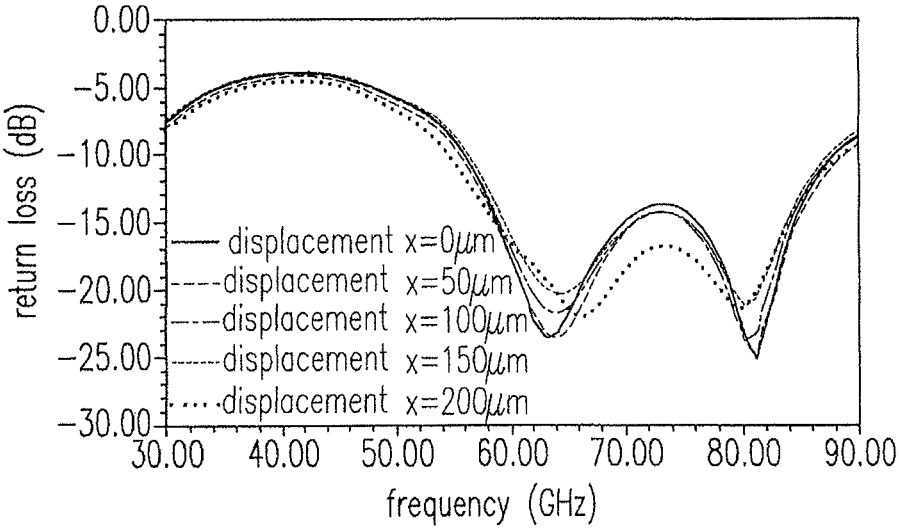
FIG. 7(*a*) shows the antenna effects of the first and the second resonant elements of the present invention, wherein the relative positions thereof are changed along the x direction.
Figure 7B:
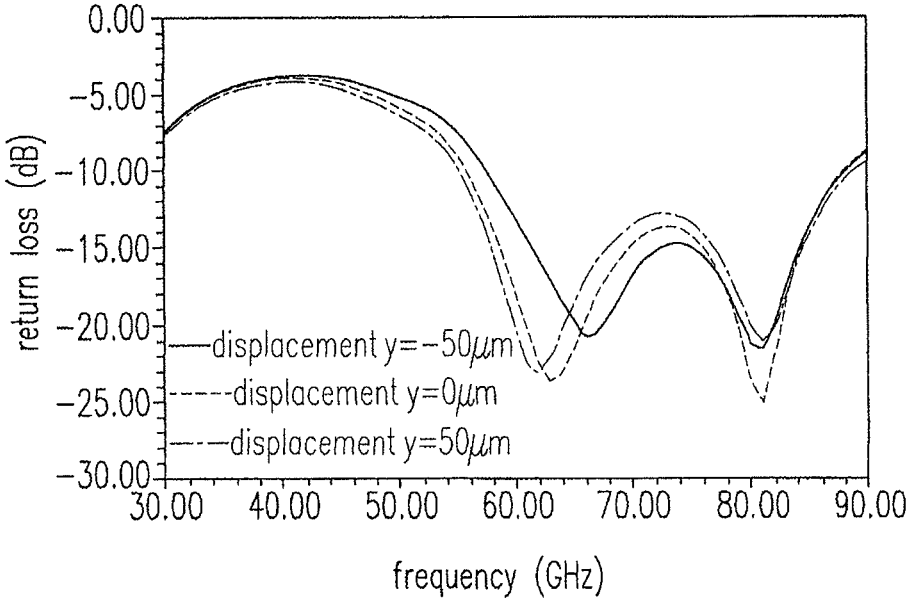

Please refer to FIG. 6, which shows the relative positions of the first and the second resonant elements 102, 202 of the present invention. The present invention transmits the antenna signal between different substrates (the silicon substrate of the IC chip and the PCB substrate) via non-contact resonant coupling 505 between the first and the second resonant elements 102, 202. Because the IC chip is assembled on the PCB substrate during the practical manufacturing process, a slight deviation on the xy plane due to the mechanical assembly is unavoidable. To understand the influence of the deviation of the assembly position on the coupling effect, the second resonant element 202 is moved, from the position facing the center of the first resonant element 102, along the x direction by 200 microns and along the y direction back and forth by 50 microns. Please refer to FIGS.7(*a*) and 7(*b*). FIG. 7(*a*) shows the antenna effects of the first and the second resonant elements 102, 202 of the present invention wherein the relative positions thereof are changed along the x direction, and FIG. 7(*b*) shows the antenna effects of the first and the second resonant elements 102, 202 of the present invention wherein the relative positions thereof are changed along the y direction. As shown in FIGS. 7(*a*) and 7(*b*), no matter what direction the second resonant element 202 is moved along, a little relative displacement does not cause a notable change in the frequency response of the antenna. Accordingly, the method and device for transmitting the antenna signal between different substrates via the non-contact resonant coupling 505 of the present invention can provide a sufficient deviation-allowable space, whose function is not affected by the position deviation of the xy plane due to the manufacturing process and which is easy to mass produce.

EMBODIMENTS

1. An integrated antenna, comprising:
   - a first resonant element 102 disposed on a chip, and receiving a first signal having a frequency from the chip; and
   - a second resonant element 202 disposed on a substrate, wherein the chip is disposed onthe substrate, and the first signal enables a non-contact resonant coupling 505 to be established between the first resonant element 102 and the second resonant element 202 due to the frequency to cause the second resonant element 202 to generate and radiate a second signal.

2. The integrated antenna of Embodiment 1, wherein the first signal has a first wavelength, and the first resonant element 102 has a first conducting path.

3. The integrated antenna of any one of Embodiments 1-2, wherein the first conducting path has a length being one selected from a group consisting of one-fourth, a half and a multiple of the first wavelength.

4. The integrated antenna of any one of Embodiments 1-3, wherein the second signal has a second wavelength, and the second resonant element 202 has a second conducting path.

5. The integrated antenna of any one of Embodiments 1-4, wherein the second conducting path has a length being one selected from a group consisting of one-fourth, a half and a multiple of the second wavelength.

6. The integrated antenna of any one of Embodiments 1-5, further comprising a radiation element, wherein the second resonant element 202 is connected to the radiation element, and sends the second signal to the radiation element.

7. An integrated antenna disposed at a first substrate 301 and a second substrate 401, and comprising:

a first coupling element 302 disposed at the first substrate 301, and receiving a feed-in signal S1; and a second coupling element 402 disposed at the second substrate 401, wherein the feed-in signal S1 enables a non-contact resonant coupling 505 to be established between the first coupling element 302 and the second coupling element 402.

8. The integrated antenna of Embodiment 7, wherein the feed-in signal S1 has a first wavelength in the first substrate 301, and the first coupling element 302 has a first conducting path.

9. The integrated antenna of any one of Embodiments 7-8, wherein the first conducting path has a length being one selected from a group consisting of one-fourth, a half and a multiple of the first wavelength.

10. The integrated antenna of any one of Embodiments 7-9, wherein the first substrate 301 has a first dielectric constant, and the first conducting path has a first length.

11. The integrated antenna of any one of Embodiments 7-10, wherein the first length is based on the first dielectric constant.

12. The integrated antenna of any one of Embodiments 7-11, wherein the feed-in signal S1 has a second wavelength in the second substrate 401, and the second coupling element 402 has a second conducting path.

13. The integrated antenna of any one of Embodiments 7-12, wherein the second conducting path has a length being one selected from a group consisting of one-fourth, a half and a multiple of the second wavelength.

14. The integrated antenna of any one of Embodiments 7-13, wherein the second substrate 401 has a second dielectric constant, and the second conducting path has a second length.

15. The integrated antenna of any one of Embodiments 7-14, wherein the second length is based on the second dielectric constant.

16. A method for operating an integrated antenna device, comprising steps of: disposing a first resonant element 102 at a first substrate 301;

feeding a signal into the first resonant element 102, wherein the first resonant element 102 is resonated in response to the signal; and disposing a second resonant element 202 at a second substrate 401, wherein the signal enables a non-contact resonant coupling 505 to be established between the first resonant element 102 and the second resonant element 202.

17. The method of Embodiment 16, wherein the signal has a frequency, and the non-contact resonant coupling 505 is established between the first resonant element 102 and the second resonant element 202 due to the frequency.

18. The method of any one of Embodiments 16-17, wherein the first substrate 301 has a first dielectric constant, the second substrate 401 has a second dielectric constant, the first resonant element 102 has a first conducting path having a first length, and the second resonant element 202 has a second conducting path having a second length.

19. The method of any one of Embodiments 16-18, wherein the first length is based on the first dielectric constant.

20. The method of any one of Embodiments 16-19, wherein the second length is based on the second dielectric constant.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. An integrated antenna, comprising:

a chip having a silicon substrate, and disposed above a printed circuit board (PCB) substrate;

a first resonant element disposed on the silicon substrate; and a second resonant element disposed on the PCB substrate, and being a radiation unit, wherein:

the chip sends a first signal having a specific frequency to the first resonant element;

the first signal enables a non-contact resonant coupling to be established between the first resonant element and the second resonant element due to the specific frequency to cause the second resonant element to generate and radiate a second signal; and the first and the second signals are entirely coupled through the non-contact resonant coupling and the first and the second resonant elements, and the non-contact resonant coupling enables the second resonant element to wirelessly transmit the second signal having the specific frequency.

2. An integrated antenna as claimed in claim 1, wherein the first signal has a first wavelength, and the first resonant element has a first conducting path configured as an open circuit structure and curved to a small size.

3. An integrated antenna as claimed in claim 2, wherein the first conducting path has a length being one selected from a group consisting of one-fourth, a half and a multiple of the first wavelength.

4. An integrated antenna as claimed in claim 1, wherein the second signal has a second wavelength, and the second resonant element has a second conducting path configured as an open circuit structure.

5. An integrated antenna as claimed in claim 4, wherein the second conducting path has a length being one selected from a group consisting of one-fourth, a half and a multiple of the second wavelength.

6. An integrated antenna disposed at a first substrate and a second substrate, and comprising:

a chip including the first substrate;

a first coupling element disposed at the first substrate, and receiving from the chip a feed-in signal having a specific frequency; and a second coupling element disposed at the second substrate, and being a radiation unit, wherein:

the first and the second substrates are a silicon substrate and a PCB substrate, respectively;

the feed-in signal enables a non-contact resonant coupling to be established between the first coupling element and the second coupling element to cause the second resonant element to generate an antenna signal; and the feed-in and the antenna signals are entirely coupled through the non-contact resonant coupling and the first and the second coupling elements, and the non-contact resonant coupling enables the second coupling element to wirelessly transmit the antenna signal having the specific frequency.

7. An integrated antenna as claimed in claim 6, wherein the feed-in signal has a first wavelength in the first substrate, and the first coupling element has a first conducting path.

8. An integrated antenna as claimed in claim 7, wherein the first conducting path has a length being one selected from a group consisting of one-fourth, a half and a multiple of the first wavelength.

9. An integrated antenna as claimed in claim 7, wherein the first substrate has a first dielectric constant, and the first conducting path has a first length.

10. An integrated antenna as claimed in claim 9, wherein the first length is based on the first dielectric constant.

11. An integrated antenna as claimed in claim 6, wherein the feed-in signal has a second wavelength in the second substrate, and the second coupling element has a second conducting path.

12. An integrated antenna as claimed in claim 11, wherein the second conducting path has a length being one selected from a group consisting of one-fourth, a half and a multiple of the second wavelength.

13. An integrated antenna as claimed in claim 11, wherein the second substrate has a second dielectric constant, and the second conducting path has a second length.

14. An integrated antenna as claimed in claim 13, wherein the second length is based on the second dielectric constant.

15. A method for operating an integrated antenna device, comprising steps of:

providing a chip including a first substrate;

disposing a first resonant element at the first substrate;

feeding from the chip a first signal having a specific frequency into the first resonant element, wherein the first resonant element is resonated in response to the first signal; and disposing a second resonant element at a second substrate, wherein:

the second resonant element is a radiation unit;

the first and the second substrates are a silicon substrate and a PCB substrate, respectively;

the first signal enables a non-contact resonant coupling to be established between the first resonant element and the second resonant element to cause the second resonant element to generate a second signal; and the first and the second signals are entirely coupled through the non-contact resonant coupling and the first and the second resonant elements, and the non-contact resonant coupling enables the second resonant element to wirelessly transmit the second signal having the specific frequency.

16. A method as claimed in claim 15, wherein the non-contact coupling is established between the first resonant element and the second resonant element due to the specific frequency.

17. A method as claimed in claim 15, wherein the first substrate has a first dielectric constant, the second substrate has a second dielectric constant, the first resonant element has a first conducting path having a first length, and the second resonant element has a second conducting path having a second length.

18. A method as claimed in claim 17, wherein the first length is based on the first dielectric constant.

19. A method as claimed in claim 17, wherein the second length is based on the second dielectric constant.

* * * * *